US005211648A

United States Patent [19]

Demeester

[11] Patent Number: 5,211,648

[45] Date of Patent: May 18, 1993

[54] DEPILATING APPLIANCE

[75] Inventor: Jacques Demeester, Croissy sur Seine, France

[73] Assignee: Braun Aktiengesellschaft, Kronberg In Taunus, Fed. Rep. of Germany

[21] Appl. No.: 582,915

[22] PCT Filed: Feb. 14, 1990

[86] PCT No.: PCT/FR90/00104

§ 371 Date: Oct. 16, 1990

§ 102(e) Date: Oct. 16, 1990

[87] PCT Pub. No.: WO90/09119

PCT Pub. Date: Aug. 23, 1990

[30] Foreign Application Priority Data

Feb. 17, 1989 [FR] France ..... 8902091

[51] Int. Cl.[5] ..... A61B 17/00

[52] U.S. Cl. ..... 606/133; 452/84

[58] Field of Search ..... 606/133; 452/82-85

[56] References Cited

U.S. PATENT DOCUMENTS 4,901,723 2/1990 Platek ..... 606/133

FOREIGN PATENT DOCUMENTS 0147285 7/1985 European Pat. Off. .

0287976 12/1989 European Pat. Off. .

2586538 10/1987 France .

*Primary Examiner*—Michael H. Thaler

*Attorney, Agent, or Firm*—Young & Thompson

[57] ABSTRACT

Appliance for plucking out unwanted hair, comprising a series of thin blades (3*a*, 3*b*) placed one behind the other with their edges parallel so as to form, in groups of two, a plurality of gripping and plucking pincers. The blades are mounted on a common support (5) which executes a translational alternating movement along an axis parallel to the edges of the blades. In addition, the blades (3*a*, 3*b*) are coupled with two small transverse actuating bars (11*a*, 11*b*) which are capable of successively spreading apart and clamping the edges of two neighboring blades (3*a*, 3*b*) which constitute the same pincers, by transverse displacement of said bars in one direction and the other. The bars themselves are actuated by control means provided opposite their ends. This appliance is intended to be used to remove hair from the skin.

14 Claims, 5 Drawing Sheets

FIG. 1
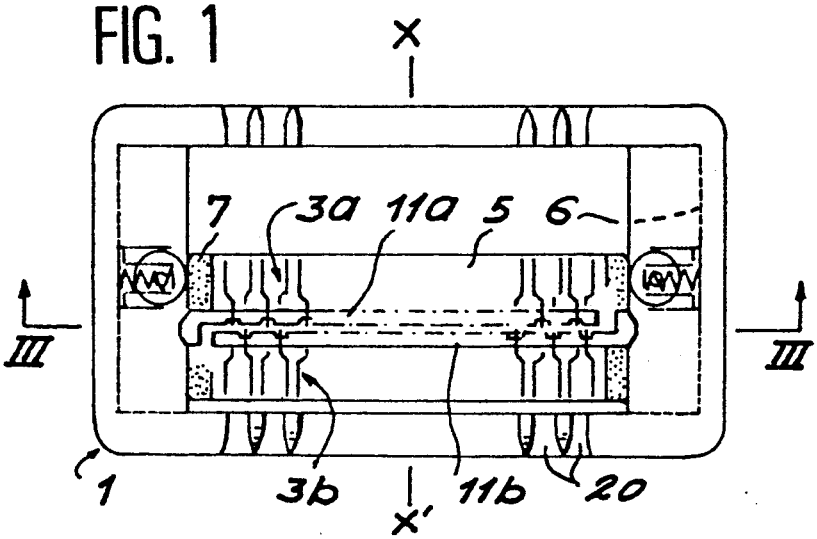
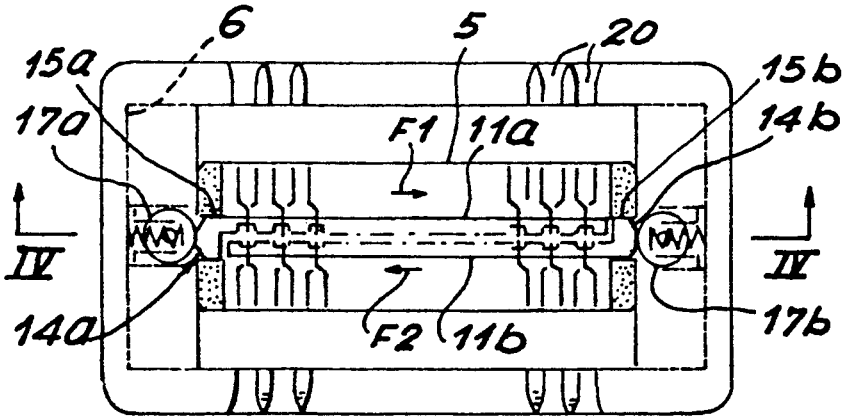
FIG. 2

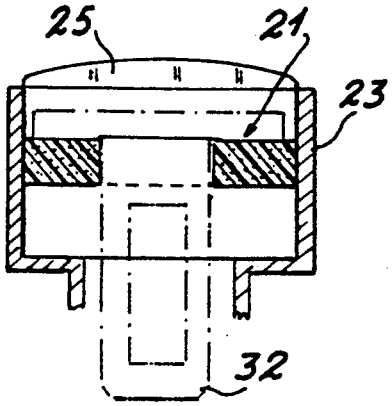
FIG. 13
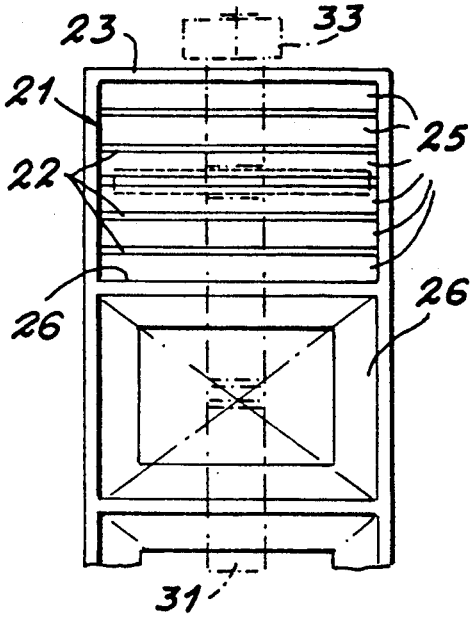
FIG. 14
FIG. 12
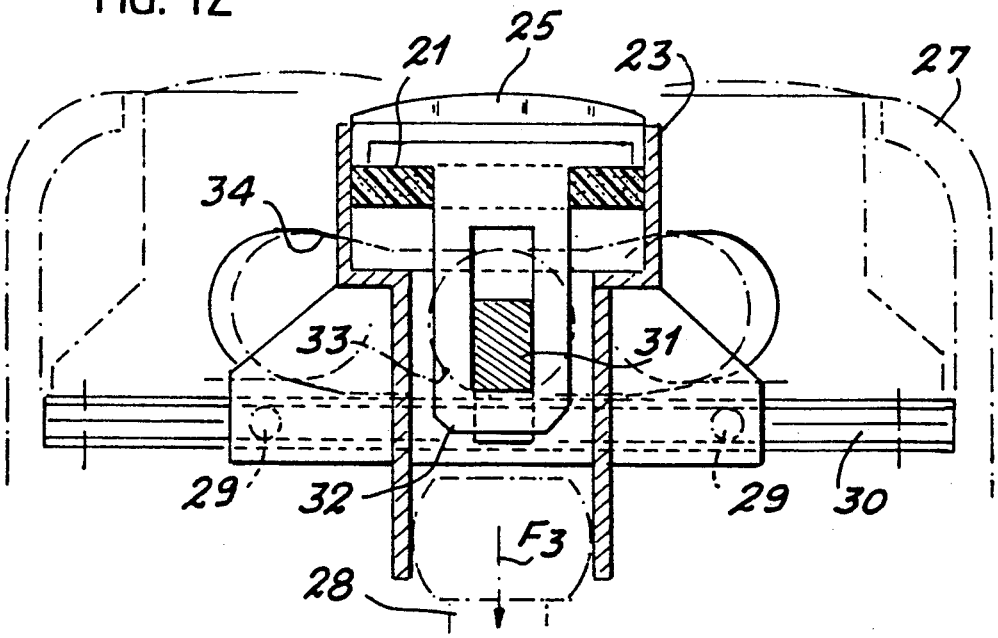

DEPILATING APPLIANCE

BACKGROUND OF THE INVENTION

The present invention relates to small depilating appliances which can be held in one hand for the removal of superfluous hairs.

More precisely, the invention relates to appliances of the type described in French patent No. 2,586,538. In order to pluck-out hairs to be removed, this appliance has a set of two gripping jaws driven in a reciprocating movement of translation along an axis parallel to the opposite edges of these jaws. In addition, the jaws are actuated by control means which are capable of causing the edges of said jaws to open and close successively during their displacement in one direction and in the other. Thus, after the hairs to be plucked were able to engage between the two jaws when they were open, they are subsequently gripped by these jaws when they close, then plucked-out by tractive force by virtue of the movement of translation to which said jaws are subjected. This appliance is completed by a protective grid placed above the two gripping jaws. This grid is provided with a series of slits which extend at right angles to the clamping plane of the two jaws. Moreover, said grid is provided at the center of its internal face with a rib which extends opposite to said clampling plane.

The efficiency of this apparatus is limited by reason of a certain number of factors, the most important of which are the following:

1. In the first place, the existence of only two gripping jaws considerably limits the probabilities of gripping of the hairs to be plucked-out.

2. In the second place, the presence of a protective grid having slits which are perpendicular to the line of clamping of the jaws makes the penetration of the hairs between these latter even more uncertain. In point of fact, the hairs rather have a tendency to be laid flat by said grid against the top face of the jaws.

3. The existence of a rib at the center of the internal face of the protective grid has the effect of making it even more probable that the hairs will be laid flat on the top of the jaws instead of being caused to engage between the edges of these latter.

4. Moreover, as a result of the thickness of said protective grid, those hairs which are in fact pinched by the jaws are not gripped at the level of the skin. In consequence, these hairs are sheared between the jaws and the grid, there being thus every chance that they will be cut instead of being plucked-out.

It is for these reasons that the aim of the present invention is to provide an improved appliance of the type considered in which the disadvantages set forth in the foregoing are removed. To this end, said appliance is so designed as to be no longer provided with any protective grid and to have an increased capacity for gripping the hairs to be plucked.

SUMMARY OF THE INVENTION

This appliance is distinguished by the fact that:

the gripping jaws are constituted by a series of blades placed next to each other with their edges parallel so as to form in pairs a plurality of gripping and plucking pincers, these blades being mounted on a support which is driven in a reciprocating movement of translation along an axis parallel to the edges of these latter, said blades are coupled with one or a number of small transverse actuating bars which are capable of successively opening and closing the edges of two adjacent blades which form pincers by transverse displacement of said bars in one direction and in the other, the bars themselves are actuated by control means which produce action on these latter during translational displacement of the assembly.

By virtue of the very fact that provision is made for a series of gripping pincers placed one after the other in succession instead of a single set of two jaws, it is readily apparent that the efficiency of this appliance is considerably enhanced. In consequence, this considerably increases the probabilities of gripping the hairs to be plucked. Moreover, by providing a very large number of gripping blades placed one after the other in succession, the protective grid which had hitherto been necessary in appliances of the type considered in order to guard against any danger of pinching of the skin can be entirely dispensed with. The fact that this grid has been suppressed has the effect of facilitating penetration of hairs between the jaws and of completely removing the danger of shearing mentioned earlier.

In an advantageous embodiment of the present appliance, the gripping blades are pivotally mounted at their feet, that is to say at the edges opposite to the clamping edges of said blades, on the common support of all the blades, the actuating bars being capable of causing pivotal displacement of said blades alternately in one direction and in the other in order to clamp the edges of two adjacent blades together and thus grip the hairs engaged between them.

In another possible embodiment of the appliance in accordance with the invention, the gripping blades are carried by the blade control bars instead of being simply actuated by these latter.

BRIEF DESCRIPTION OF THE DRAWINGS

However, other particular features and advantages of the present appliance will become apparent from the following description, reference being made to the accompanying drawings which are given solely by way of indication, and in which:

FIG. 1 is an overhead plan view of the working head of a depilating appliance in accordance with the invention;

FIG. 2 is a similar view representing a different position of the moving system constituted by the gripping blades and their common support;

FIG. 12 is a transverse sectional view taken along line XII—XII of FIG. 10 but to a different scale;

FIG. 13 is a partial transverse sectional view of the moving system of the working head;

FIG. 14 is a partial top view of the same moving system.

DESCRIPTION OF THE PREFERRED EMBODIMENTS

The working head of the appliance shown by way of example in FIGS. 1 to 4 has a rigid body 1 having the general shape of a cup which is mounted separately on the end of a small casing 2 containing an electric drive motor. The casing is intended to be held in one hand in order to displace the working head in contact with the skin.

Figure 3:
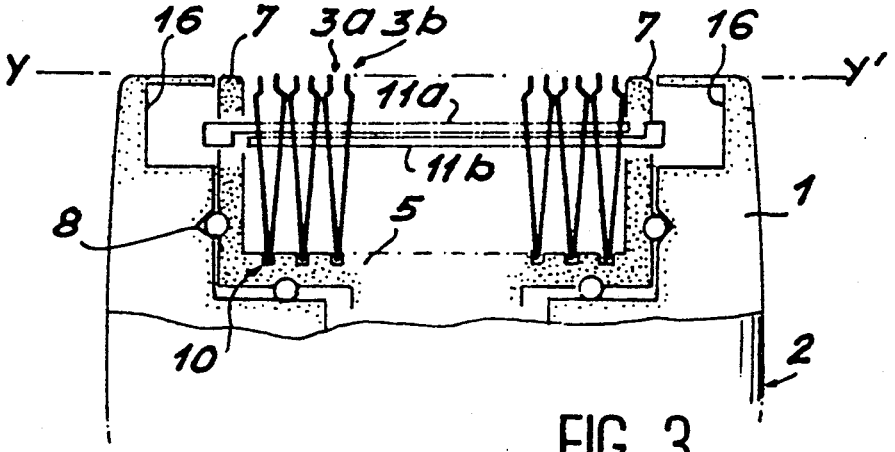
FIGS. 3 and 4 are sectional views taken respectively along line III—III of FIG. 1 and along line IV—IV of FIG. 2.
Figure 4:
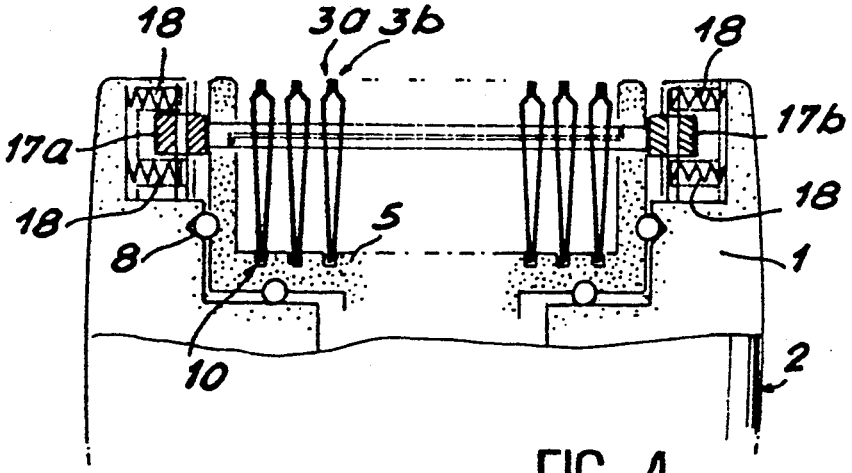
Figure 5:
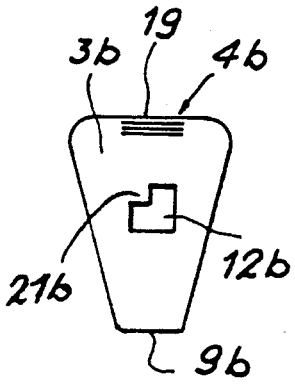
FIGS. 5 and 5A are views in elevation of two complementary blades which form one and the same hair-plucking pincers.
Figure 5A:
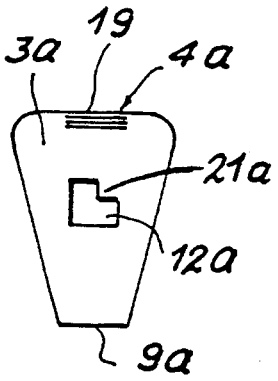
Figure 6:
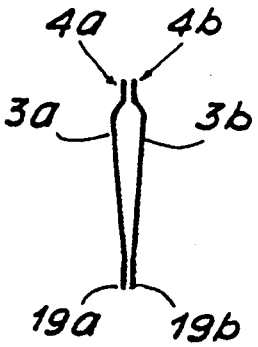
FIG. 6 is a view in side elevation of these two blades.
Figure 7:
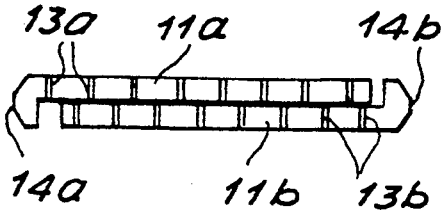
FIG. 7 is an overhead plan view of two control bars provided for actuating the gripping blades shown in FIGS. 5 and 5A.

The elements for plucking-out hairs to be removed consist of a series of thin blades 3*a* and 3*b* alternately which are intended to form in pairs a plurality of hair-plucking pincers, one of the pincers thus formed by two adjacent blades 3*a* and 3*b* being in fact shown separately in FIG. 6. These blades are placed one after the other in succession with their clamping edges 4*a* or 4*b* placed in parallel relation.

These different blades are mounted on a common support 5 having a U-shaped cross-section. The transverse arm of said support is placed against the bottom of the cup 6 provided in the body 1 of the working head. In regard to the lateral arms 7 of said support, they are placed against the corresponding walls of said cup. The support thus formed is smaller in width than the cup 6 and is.. mounted so as to be capable of moving along an axis X—X parallel to the edges 4*a* and 4*b* of the gripping blades.

A reciprocating movement of translation is imparted to the support in one direction and in the other along said axis (see arrows F1 and F2.). The support is driven by suitable mechanical means which are not shown in the drawings. In order to facilitate displacement of said support, balls 8 are advantageously interposed between this latter and the corresponding walls of the cup 6, said balls being placed within complementary grooves.

It is worthy of note that the clamping edges 4*a* and 4*b* of the gripping blades are level with the plane Y-Y' on which the edges of the body 1 of the working head as well as the edges of the support 5 are located. This is therefore the working plane of the appliance. However, the clamping edges of the gripping blades could if necessary be in a slightly projecting position or on the contrary be in a slightly withdrawn position with respect to this plane.

In the example which is illustrated, the gripping blades 3*a* and 3*b* are pivotally mounted at their feet, that is to say at the edges opposite to the clamping edges 4*a* and 4*b* of said blades. To this end, the edges 9*a* and 9*b* of two complementary blades 3*a* and 3*b* which form together a pair of gripping pincers are engaged within one and the same groove 10 formed in the bottom of the support 5. This support thus has a series of such grooves which extend parallel to the axis X-X'. By virtue of this arrangement, the blades 3*a* and 3*b* are capable of pivoting between an open position shown in FIG. 3 and a closed position illustrated in FIG. 4.

Pivotal displacement of these blades, alternately in one direction and in the other, is controlled by two small actuating bars 11*a* and 11*b*. These two bars are placed against each other and are engaged together within an opening 12 formed in the different blades 3*a* and 3*b*. The arrangement is such that the bar 11*a* is coupled with all the blades 3*a* whilst the bar 11*b* is coupled with all the blades 3*b*. To this end, the openings 12*a* and 12*b* of the blades 3*a* and 3*b* have a different contour so as to be provided in each case with a tooth 21*a* or a tooth 21*b* in alternate sequence, said tooth being capable of engaging in a groove 13*a* of the bar 11*a* or within a groove 13*b* of the bar 11*b*.

At one end of the two bars, one bar has an actuating head 14*a* or 14*b*. This latter is slidably mounted within an opening 15*a* or 15*b* formed in the corresponding side of the moving support 5. In the normal position, these two heads project from the sides of said support to a slight extent as shown in FIGS. 1 and 2, provision being made for resilient restoring means which accordingly tend to maintain the gripping blades in the open position. The actuating heads 14*a* and 14*b* of the two control bars accordingly project within two recesses 16 provided on each side of the body of the working head.

However, at an intermediate point of travel of the moving system constituted by the support 5 and the gripping blades, provision is made for control means which have a fixed position and are capable of producing action on the actuating heads 14*a* and 14*b* of the two bars 11*a* and 11*b* in order to cause them to slide in opposite directions as indicated by the arrows F1 and F2. In the example illustrated, these control means consist of two rollers 17*a* and 17*b*, the shafts of which are thrust by springs 18 towards the sides 7 of the moving support 5. Thus, when the actuating heads 14*a* and 14*b* of the bars 11*a* and 11*b* come into position opposite to said rollers during a movement of translation of the moving support 5 in one direction or the other, said rollers thrust back said bars in the direction of the arrows F1 and F2. This accordingly initiates a pinching action of the different complementary blades 3*a* and 3*b* which form a corresponding number of pairs of pincers.

Under these conditions, the hairs which had previously been engaged between two complementary blades 3*a* and 3*b* are gripped by the clamping edges of these latter. These hairs are then plucked-out by virtue of the movement of translation imparted to the moving system formed by the support 5 and the gripping blades. The blades then open-out once again so as to permit engagement of other hairs between them so that these latter should in turn be gripped and plucked-out during the subsequent movement of closure of these blades, and so on in sequence.

The gripping blades can advantageously be made of metal or of very rigid plastic. The two blades of any one pair of pincers need not be independent of each other but may instead be formed of one piece folded-back in the zone of articulation corresponding to the edges 9*a* and 9*b*. The blades may accordingly remain open in the state of rest solely under the action of elasticity of the part thus formed.

The clamping edges of the gripping blades can advantageously have an elbowed portion 19 in order to achieve greater hair-gripping efficiency. Preferably, the internal face of this portion can be treated so as to have a degree of roughness such as to prevent slipping of the hairs between the gripping blades.

In order to compensate for irregularities of shape of the thrust bars and of the gripping blades, these latter should preferably have a certain elasticity. Mounting of the rollers 17*a* and 17*b* on springs 18 makes it possible to compensate for possible wear of moving parts. It is readily apparent that the force of these springs must be equal to the sum of the forces which are necessary in order to close each pair of hair-plucking pincers and of the gripping forces which are necessary in order to imprison the hairs to be plucked-out in said pincers.

In order to use the appliance, it is only necessary to displace its working head in contact with the skin. The hairs to be removed then engage quite naturally between the gripping blades when these latter are in the open position. They are then gripped and plucked-out as described earlier. The amplitude of the alternating motion imparted to the moving system constituted by the support 5 and the gripping blades must be sufficiently great to obtain complete extraction of the hairs.

As has already been indicated, the efficiency of the present appliance is considerably enhanced with respect to prior art appliances of the same type. This is due in the first place to the presence of a plurality of hair-plucking pincers instead of a single set of two jaws. Furthermore, the formation of each pair of pincers by means of two thin blades makes it possible to provide a large number of such pairs of pincers in respect of a limited space corresponding to the usual dimensions of the working head of a depilating appliance. All things being equal, the efficiency of the appliance in accordance with the invention is multiplied in the ratio of the sum of the lengths of the different hair-plucking pincers which exist in this appliance to the length of the single gripper of the prior art appliances mentioned earlier. This ratio can in fact be of the order of 10:1 in respect of equal overall dimensions. However, the efficiency of this appliance is also due to the suppresion of the protective grid usually provided on an appliance of this type. This suppression is made possible by the fact that the gripping blades are provided in large number and in very closely spaced relation. This guards against any danger of engagement of the skin between these blades, with the result that the presence of a protective grid serves no purpose whatsoever. Furthermore, by suppressing said grid, it is possible to prevent any danger of shearing of hairs between this latter and the hair-plucking pincers. However, a further effect of this suppression is that the clamping edges of the pincers can be brought close to the skin to the maximum extent, with the result that the hairs are gripped at the level of the skin and that any risk of breaking of hairs is avoided.

Figure 8:
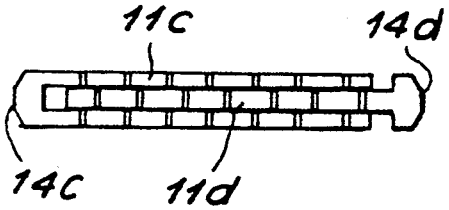
FIG. 8 is a similar view representing another form of construction of said bars.
Figure 9:
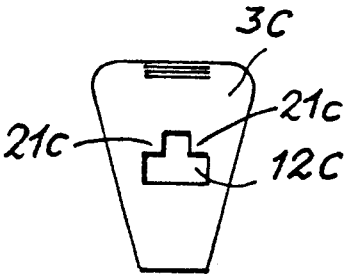
FIGS. 9 and 9A are views which are similar to FIGS. 5 and 5A and illustrate the gripping blades employed with the bars shown in FIG. 8.
Figure 9A:
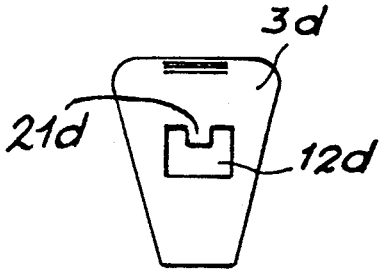

It is readily apparent that the appliance considered is not limited solely to the examples of construction which have been described in the foregoing. Thus FIG. 8 illustrates an alternative form of construction of the small bars for actuating the gripping blades. In this alternative embodiment, the two corresponding bars 11*c* and 11*d* are engaged one within the other. To this end, one bar has an elongated U-shape and the other is engaged between the two arms of said U. As in the previous embodiment, these bars have actuating heads 14*c* and 14*d* at their two ends. However, this modification of the actuating bars entails the need for modification of the openings provided in the gripping blades. In such a case, these openings must in fact assume the shape of the openings 12*c* and 12*d* shown in FIGS. 9 and 9A in order to have teeth 21*c* and 21*d* which are capable of being engaged within the grooves provided on each of the two bars 11*c* and 11*d*.

Instead of being pivotally mounted at their foot, the gripping blades 3*a* and 3*b* could be pivotally mounted at an intermediate point of their height. Moreover, instead of being pivotally mounted on the moving support 5 and only coupled with the actuating bars, said gripping blades could be carried alternately by both of these two bars. In such a case, closing and opening of the gripping pincers would also be obtained by means of movements in opposite directions of the complementary blades which constitute these latter. This would, however, involve translational movements and not pivotal movements. But the final result would be the same.

The rollers 17*a* and 17*b* which control the closing of the hair-plucking pincers could be replaced by other elements designed to perform the same function. These elements could possibly consist of ramps for producing a closing movement of the hair-plucking pincers over a greater distance of travel of the moving system formed by the support 5 and by said blades.

If so required, it would be possible to contemplate an arrangement such that closing of the hair-plucking pincers takes place only in a predetermined direction of the alternating movement of translation. These pincers remain open throughout the duration of their displacement in opposite directions in order to facilitate the engagement of hairs between these latter.

With a view to facilitating the presentation of hairs opposite to the gripping blades, the edges of the body 1 of the working head can be provided with lateral slits 20. Once again, however, many other variants may be contemplated for this appliance.

Thus the gripping blades could pivot at an intermediate point of their length instead of pivoting at their feet as is contemplated in FIGS. 1 to 9. In such a case, the pivotal motion of the blades could be controlled by actuating them at their feet or at any other suitable location by means of sliding bars similar to the bars 11*a* and 11*b*, or by making use of other suitable control means.

Moreover, the gripping blades need not be of the pivoting type but could be mounted so as to be capable of moving in translation along the axis Y-Y', said blades being capable of moving alternately in one direction and in the opposite direction in order to ensure that two adjacent blades carry out successively a movement of closure followed by a movement of relative withdrawal. In such a case, the blades of each series could be secured to a common support so as to form with this latter a kind of single-piece comb, the two moving combs thus provided being engaged one within the other and driven in reciprocating movements of translation in opposite directions with respect to each other.

In regard to FIGS. 10 to 14, they illustrate yet another form of construction in which the gripping jaws are constructed in accordance with a wholly different design. In fact, these jaws are formed by strips cut in small plates of resilient material by forming a series of parallel slits in said plates.

Specifically in the example shown in FIGS. 10 to 14, provision is made for four small plates 21 of resilient material which are arranged in succession in the transverse direction and each of which has a series of slits 22 extending in a direction parallel to the axis Z-Z' of translation of the moving support 23 which carries said small plates. The slits are formed in only part of the thickness of the small plates 21, namely in that portion which is directed towards the work surface. In consequence, these slits open freely to the exterior. On the opposite side, they communicate with cavities 24 formed within the thickness of the plates 21. The slits thus delimit between them a corresponding number of parallel strips 25 which are placed side by side and are intended to constitute the gripping jaws of the present appliance.

The small plates 21 have the shape of square or rectangular slabs and are housed within separate compartments 26 which are provided in the moving support 23 and the bottom of which has a wide opening 26*a*. The moving support 23 assumes an elongated shape and extends over the entire length of the corresponding end of the casing 27 of the appliance. As in the form of construction described earlier, said support is driven in a reciprocating movement of translation along the axis Z-Z' in one direction and in the other. It is driven by a moving arm 28 which is in turn actuated by a suitable mechanism. The moving support is guided in these displacements by balls 29 engaged in guide tracks 30 constituted by grooves formed in the corresponding walls of the casing 27.

Figure 10:
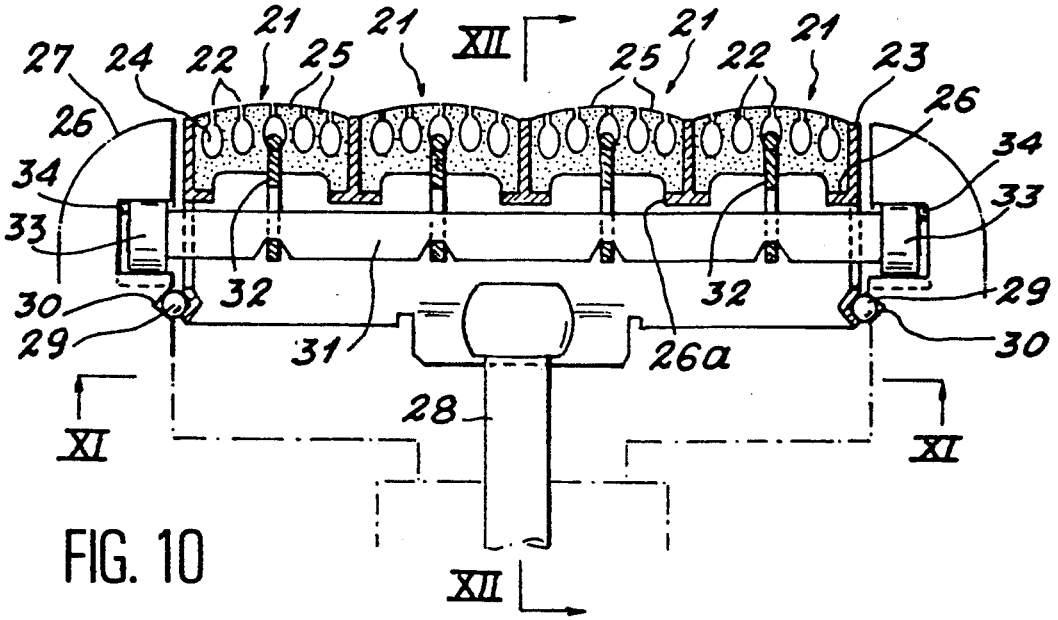
FIG. 10 is a view which is similar to FIGS. 3 and 4 but which illustrates another form of construction of the working head of the depilating appliance in accordance with the invention.
Figure 11:
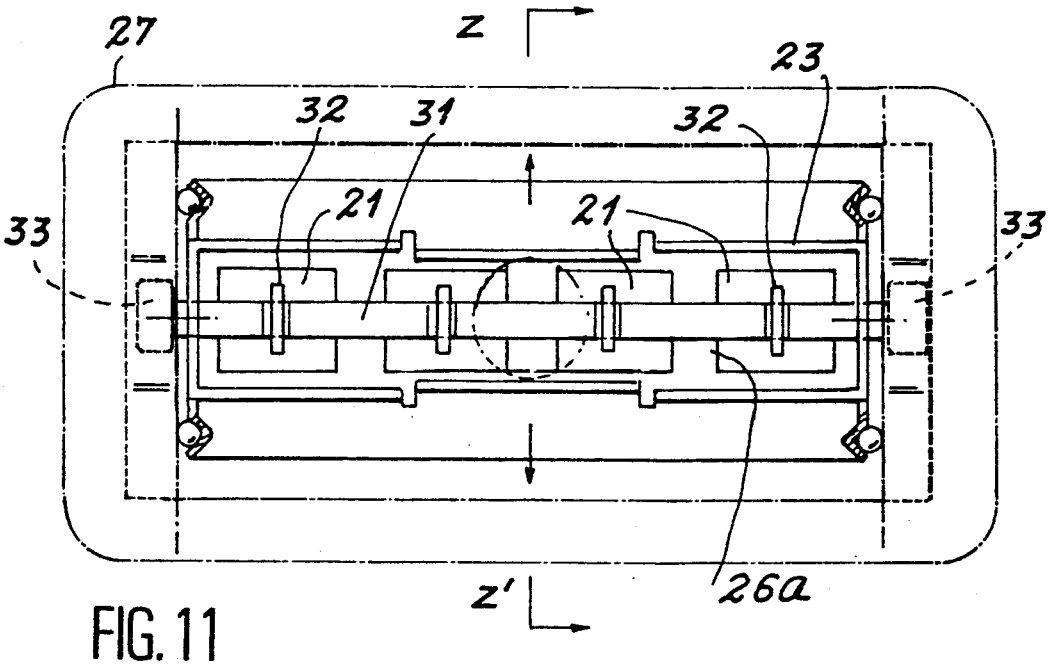
FIG. 11 is a bottom plan view taken along line XI—XI of FIG. 10.

In the normal state of the small resilient plates 21, the slits 22 of these latter are freely open as shown in FIG. 10. Under these conditions, when the working head of the appliance is displaced over the skin, the hairs to be plucked are capable of engaging in these slits during the movement of translation of the moving system formed by the support 23 and the different plates 21. Accordingly, provision is made for mechanical means which are capable of causing, at a predetermined moment, the contraction of the resilient plates 21 by bending and consequently the closure of the slits 22 so as to grip the hairs between the corresponding strips 25 which thus form gripping jaws.

In the example shown in FIGS. 10 to 14, the means thus provided comprise a transverse bar 31 which is parallel to the moving support 23 and coupled with this latter in translational motion. This bar is attached to each of the resilient plates 21 by means of a connecting bar 32. The ends of said transverse bar project beyond the corresponding ends of the moving support 23 and are each adapted to carry a roller 33 engaged in a track formed by a channel 34 formed in the corresponding wall of the casing 27.

In point of fact, each roller-track is adapted to constitute a cam which is capable of causing the displacement of the transverse bar 31 in the direction of the arrow F3 of FIG. 12 or in other words away from the work surface of the appliance when the moving support 23 reaches the mid-point of its travel in translational motion in one direction and in the other. To this end, the guide tracks 34 are given an elbowed shape in order to have at the center a portion which is displaced in the direction of the arrow F3.

Thus, during each movement of travel of the moving support 23 in one direction and in the other, the transverse bar 31 is caused to apply a tractive force on the different resilient plates 21 in the direction of the arrow F3. This tractive force accordingly produces deformation of each small plate 21 which is thus caused to contract by bending. This has the effect of applying the strips 25 against each other and consequently of gripping the hairs which are engaged between the strips at this moment. Plucking of these hairs is achieved in the same manner as in the previous embodiment, that is to say under the action of the movement of translation of the moving support 23 in one direction and in the other.

In consequence, the operation of the working head corresponding to this alternative embodiment is the same as before. However, this variant offers the advantage of greater simplicity. This is clearly due to the fact that, instead of being constituted by separate blades mounted on a common support, the gripping jaws are formed in small plates of resilient material which are simply provided with parallel slits so as to form gripping jaws placed side by side with a small interval between them. This accordingly results in very great simplification of the mechanism and consequently in an appreciable reduction of the cost price.

However, the mechanical means for causing contraction of the resilient plates 21 could be different from those provided in the example described in the foregoing. Furthermore, many alternative modes of execution may be contemplated as in the preceding form of construction.

Finally, it is worthy of note that the invention is directed not only to a depilating appliance of this type considered as a whole but also to the working head of this appliance. Said working head is accordingly designed to be fitted on the casing of an existing appliance comprising a drive motor and a mechanism which is capable of carrying out the reciprocating movement of translation of the moving support 5 of the gripping blades.

I claim:

1. In a depilating appliance for plucking-out hairs to be removed, provided with gripping jaws mounted on a common support driven by mechanical means in a reciprocating movement of translation along an axis parallel to the opposite edges of said jaws which are actuated during this movement by control means capable of causing the edges of said jaws to open and close successively during the displacement of the support in one direction and in the other, the improvement comprising: said gripping jaws being constituted by a series of gripping blades (3*a*, 3*b*) placed next to each other with their clamping edges (4*a*, 4*b*) constantly parallel to each other so as to form in pairs a plurality of gripping and plucking pincers, said blades (3*a*, 3*b*) being coupled with at least two small transverse juxtaposed actuating bars (11*a*, 11*b* or 11*c*, 11*d*) which are capable of successively opening and closing the clamping edges (4*a*, 4*b*) of two adjacent pincer-forming blades (3*a*, 3*b*) by reciprocating transverse displacement of said bars in opposite directions, said bars (11*a*, 11*b*, 11*c*, 11*d*) being themselves actuated by said control means (17*a*, 17*b*) which produce action on said bars during translational displacement of the support (5).

2. Depilating appliance in accordance with claim 1, wherein the gripping blades (3*a*, 3*b*) are pivotally mounted at their feet at the edges opposite to their clamping edges on the common support (5), said actuating bars (11*a*, 11*b*) being capable of causing pivotal displacement of said blades (3*a*, 3*b*) alternately in one direction and in the other in order to cause the edges (4*a*, 4*b*) of two adjacent blades to close together and grip the hairs engaged between them.

3. Depilating appliance in accordance with claim 2, wherein the blade support (5) has a series of grooves (10) extending in a direction parallel to the axis (X-X') of displacement of said support, and the edges (9*a*, 9*b*) at the feet of two complementary blades (3*a*, 3*b*) forming a pair of gripping pincers are engaged in one and the same groove (10) of said support.

4. Depilating appliance in accordance with claim 2, wherein two complementary blades (3*a*, 3*b*) of any one pair of gripping pincers are constituted by a folded-back part formed in one piece, the point of folding of said part being such as to constitute the articulation of said two blades at their foot.

5. Depilating appliance in accordance with claim 2, wherein said two actuating bars (11*a*, 11*b*) of the gripping blades (3*a*, 3*b*) are engaged through openings (12*a*, 12*b*) of said blades, said openings being provided with a special cut-out portion so as to have a tooth (21*a* or 21*b*) which is engaged in a groove (13*a*, 13*b*) of either one actuating bar or the other (11*a*, 11*b*).

6. Depilating appliance in accordance with claim 1, wherein the gripping blades (3*a*, 3*b*) are carried by the transverse bars (11*a*, 11*b*) which actuate said blades.

7. Depilating appliance in accordance with claim 1, further including a working head, wherein the support (5) of the gripping blades (3*a*, 3*b*) has a U-shaped cross-section and is mounted in a cup (6) provided in the body (1) of the working head of said appliance so as to be capable of displacement in one direction and in the other parallel to the clamping edges (4*a*, 4*b*) of the gripping blades.

8. Depilating appliance in accordance with claim 7, wherein the actuating bars (11*a*, 11*b*) have ends (14*a*, 14*b*) which pass through the sides (7) of the moving support (5), and provision is made opposite to their path of travel for said control means which are capable to acting on said bars (11*a*, 11*b*) in order to thrust them in the opposite direction.

9. Depilating appliance in accordance with claim 8, wherein said control means consist of two rollers (17*a*, 17*b*) subjected to the pressure of thrust springs (18).

10. Depilating appliance in accordance with claim 1, wherein each of said gripping blades (3*a*, 3*b*) has an elbow (19*a*, 19*b*) near its clamping edge (4*a*, 4*b*).

11. Working head for equipping a depilating appliance, said head comprising: clamping jaws constituted by a series of thin blades (3*a*, 3*b*) placed next to each other with their edges (4*a*, 4*b*) disposed in parallel relation so as to form in pairs a plurality of gripping and plucking pincers, said blades being mounted on a support (5), said support adapted to be mechanically driven in a reciprocating movement of translation along an axis parallel to the edges of said blades, said blades (3*a*, 3*b*) being coupled with at least two transverse juxtaposed actuating bars (11*a*, 11*b* or 11*c*, 11*d*) which are capable of causing successive opening and closing of the edges (4*a*, 4*b*) of two adjacent blades (3*a*, 3*b*) by reciprocating transverse displacement of said bars in opposite directions, said bars being themselves actuated by control means which produce action on said bars during translational displacement of the support.

12. Depilating appliance for plucking-out hairs to be removed, comprising: gripping jaws mounted on a support (23) driven in a reciprocating translation movement, said jaws being constituted by parallel gripping strips (25) cut in at least one small plate (21) of resilient material, mechanical actuating means for causing during the translational movement of the support (23) the contraction by bending of said at least one plate and consequently the closing-together of the gripping strips (25), slits (22) being cut in the outer portion of said at least one plate, all of said slits constantly extending in a direction parallel to the axis (Z-Z') of displacement of the moving support (23), so that the edges of the gripping strips are kept parallel to each other during the reciprocating movement of the support, wherein the means for causing contraction of said at least one small plate (21) of resilient material include a transverse bar (31) which is parallel to the moving support (23) and is coupled with said support in translational motion, said bar being placed in contact with cams (34) which are capable of displacing said bar in a direction away from the work surface of the appliance followed by a return to its normal position, during the reciprocating movement of translation.

13. Depilating appliance in accordance with claim 12, wherein the transverse bar (31) which causes contraction of the small plates (21) of resilient material is coupled with each plate by means of a connecting bar (32).

14. Depilating appliance in accordance with claim 12, wherein the transverse bar (31) which causes contraction of the small plates (21) of resilient material is provided at each end with a roller (33) placed in a track (34) constituting said cams which are capable of displacing said bar (31).

* * * * *